United States Patent [19]

Dawson

[11] 4,189,256

[45] Feb. 19, 1980

[54] PILE GUIDES

[76] Inventor: Robin Dawson, 8 Holts Green, Great Brickhill, Milton Keynes, Buckinghamshire, England

[21] Appl. No.: 928,619

[22] Filed: Jul. 27, 1978

[51] Int. Cl.[2] ..... E02D 13/04

[52] U.S. Cl. ..... 405/277; 405/232; 405/274

[58] Field of Search ..... 405/274–281, 405/232; 29/281.6

[56] References Cited

U.S. PATENT DOCUMENTS

| | | | |
|---|---|---|---|
| 591,167 | 10/1897 | Hammerstrom et al. . | |
| 1,135,448 | 4/1915 | Fiddle . | |
| 1,512,559 | 10/1924 | Moore . | |
| 2,074,906 | 3/1937 | Hausler | 405/278 |
| 2,122,835 | 7/1938 | Deros | 405/278 |
| 2,161,482 | 6/1939 | Miller et al. | 29/281.6 |
| 2,583,928 | 1/1952 | Caudill | 29/281.6 |
| 2,833,119 | 5/1958 | Molloy | 405/276 |
| 2,968,931 | 1/1961 | McGraw | 29/281.6 |
| 4,028,901 | 6/1977 | Barber | 405/277 |
| 4,083,192 | 4/1978 | Diekman | 405/281 |

FOREIGN PATENT DOCUMENTS

| | | | |
|---|---|---|---|
| 1922564 | 1/1970 | Fed. Rep. of Germany | 405/279 |
| 6514165 | 5/1966 | Netherlands | 405/279 |
| 1483188 | 8/1977 | United Kingdom | 405/278 |

*Primary Examiner*—Dennis L. Taylor

*Attorney, Agent, or Firm*—Cushman, Darby & Cushman

[57] ABSTRACT

A guide for pitching interlocking piles has a carrier with a clamp at its upper end with positive gripping elements for the bottom edge of a pile to be pitched. A pair of pivoted shafts at the lower end of the carrier have engagement rollers conforming to the profile of opposite faces of the lateral edge region of the adjoining pitched pile. The shafts are pivoted apart to position the guide on said pitched pile and the rollers are then engaged with said pile by pivoting the shafts to parallel positions. Spring biassing on the guide urges the edges of the piles into lateral alignment for interlocking engagement when the pile to be pitched is lifted above the pitched pile.

11 Claims, 8 Drawing Figures

PILE GUIDES

BACKGROUND OF THE INVENTION

This invention relates to guides for use in guiding piles during pitching in interlocking sheet piling.

In such piling, a pile to be pitched is lifted up by a crane to above the level of the adjacent already pitched pile and the adjoining lateral edge portions of the piles must be precisely aligned so that on lowering the pile being pitched said lateral edge portions of the two piles are interlocked. This has been done by having a man stationed at the top of the previously pitched pile to guide the pile being pitched manually into position, but that is a difficult and dangerous operation, particularly in windy conditions, and in bad weather it becomes impossible.

Accordingly various forms of guide apparatus have been devised to enable the guiding of piles to be carried out without the need for having a man in this exposed and dangerous position. Examples of such known guides are to be found in U.S. Pat. Nos. 2,161,482, 2,583,928, 2,833,119, 2,968,931 and 4,028,901, and U.K. Pat. No. 1,483,188, but these have a number of disadvantages.

For example, these guides are not easily attachable to the two piles. With the guides of U.S. Pat. Nos. 2,161,482 and 2,833,119 it is necessary to drill holes in the piles to attach them, while the guide of U.S. Pat. No. 2,583,928 must be secured to both piles simultaneously, which can be difficult or impossible in adverse conditions. With the guide of U.S. Pat. No. 2,968,931, clamping to the already pitched pile requires a complicated procedure including the separate securing of two different parts either of which may therefore be overstrained before the pile has been properly engaged. The guides of U.S. Pat. No. 4,028,901 must first be placed at the top of a pitched pile so that a crane must be employed to place the guide in position which requires the exercise of considerable skill and is also made more difficult by adverse weather conditions.

These known guides also have deficiencies in the guidance they offer. Generally, sliding engagement faces are provided in order to locate the two piles satisfactorily in the required relative orientation, but as a result the function of the guides can be seriously impaired, for example due to dimensional variations or due to increased bearing pressure resulting from high wind loads. These sliding engagements can also jam if the pile to be pitched is skewed due to careless handling.

In U.S. Pat. No. 2,583,928, where the section of the pitch pile has a lobed interlock edge, a pair of rollers engage the reduced thickness of the edge immediately behind said lobe, but they offer little support against relative pivoting movement between the piles about a vertical axis. In U.S. Pat. No. 4,028,901 there is positive guidance of the pile being pitched by means of a series of rollers connected in a template-like device, but this requires a relatively massive structure, which, as already mentioned, must be fixed to the top of the already pitched pile.

On the question of attachment of the guides, since the principle of operating at ground level requires the guide to be fixed to the bottom of the pile to be pitched while it is drawn up the side of the already pitched pile, it is also desirable to ensure that the guide is securely fixed to the pile to be pitched so that any increase of resistance to movement along the other pile will not dislodge the guide and leave it out of alignment. This condition is difficult to satisfy if the guide is only frictionally held and is satisfied in the known guide only by drilling attachment holes at the bottom of the piles to be pitched.

SUMMARY OF THE INVENTION

One object of the present invention is to provide a guide for guiding interlocking piling when it is pitched, which is compact and easy to use and can be operated without requiring a man to be positioned at the top of the piling or needing the use of a crane to manoeuvre the piling in order to make the interlock connection.

Another object of the invention is to provide a guide which, after it has been secured to the pile to be pitched, can be aligned and engaged with the previously pitch pile in a single operation.

A further object of the invention is to provide a guide which can quickly and easily be adapted to use with different pile sections or with different lateral edge sections of non-symmetrical piles.

Yet another object of the invention is to provide a guide that can be positively locked onto the pile to be pitched so that it will not be dislodged and shifted out of alignment, and that is able to ride freely up the already pitched pile after it has been engaged therewith.

According to the invention, there is provided a guide for guiding a pile during pitching said pile with a portion of a lateral edge region of the pile in engagement with a portion of a lateral edge region of an already-pitched pile, the guide comprising a carrier, clamping means at an upper region of the carrier for securing the guide to the bottom of the pile being pitched at said lateral edge region thereof, engagement means at a lower region of the carrier for engaging the guide with said lateral edge region of the previously pitched pile, said engagement means comprising a pair of shafts side-by-side, a pivotable connection between at least one of said shafts and the carrier for displacement of said shaft away from the other shaft, means for locking said at least one shaft against pivotal movement on said connection to hold the two shafts substantially parallel, at least one roller on each said shaft, said rollers engaging opposite side faces of said lateral edge region of the already-pitched pile, the rollers having profiles conforming generally to the profiles of the faces of the pile lateral edge region tha they engage, and biasing means on said carrier for causing relative displacement between said clamping means and said engagement means whereby, when the pile being pitched is above the level of the already-pitched pile with the rollers engaging the already-pitched pile, the biasing means urge the pile being pitched into the correct lateral position for engagement of said lateral edge portions of the two piles.

Some embodiments of the invention will be described by way of example with reference to the accompanying drawings.

DESCRIPTION OF THE PREFERRED EMBODIMENTS

Figure 1:
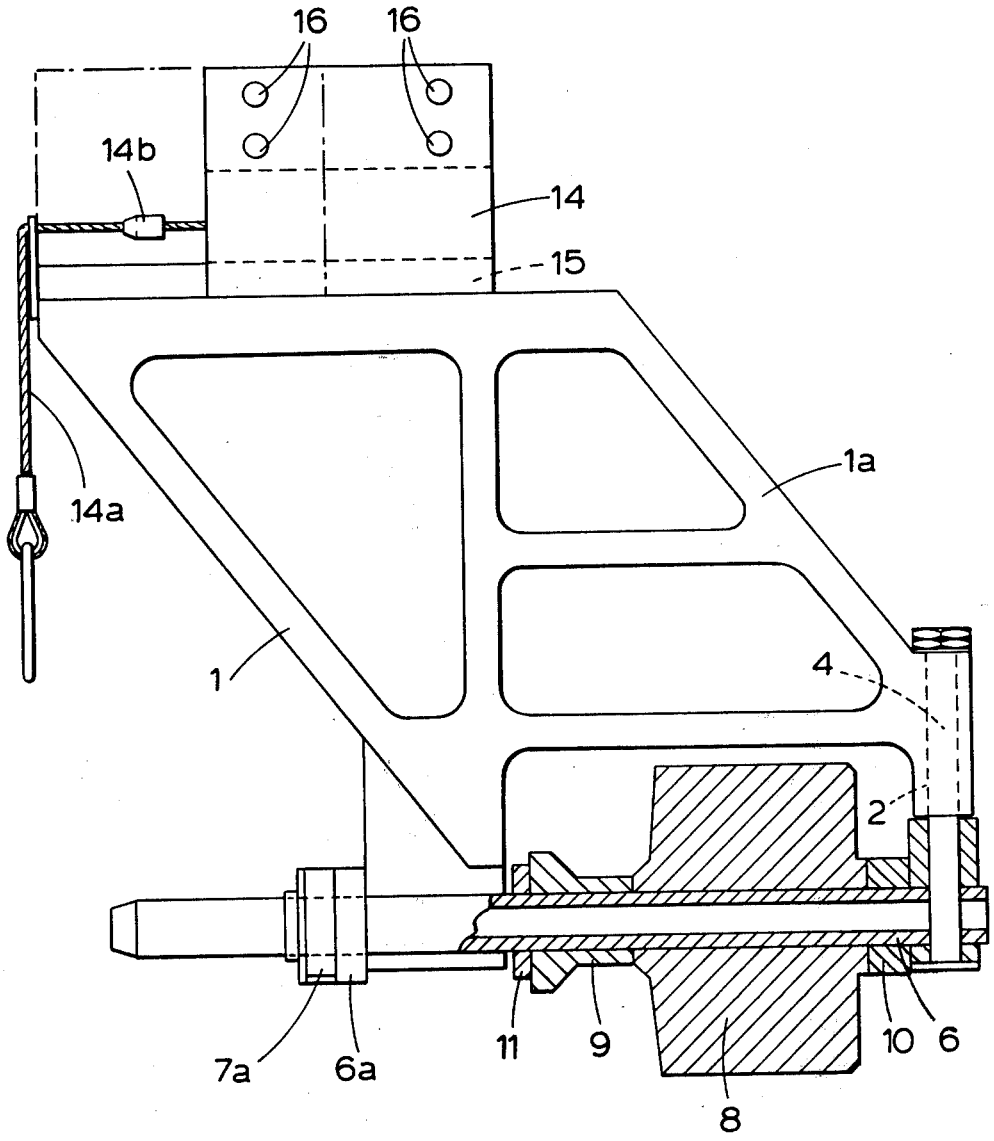
FIGS. 1, 2 and 3 are a side elevation, a plan view and an end elevation view respectively of a guide according to the invention arranged for use in pitching Larssen or U section piles.
Figure 2:
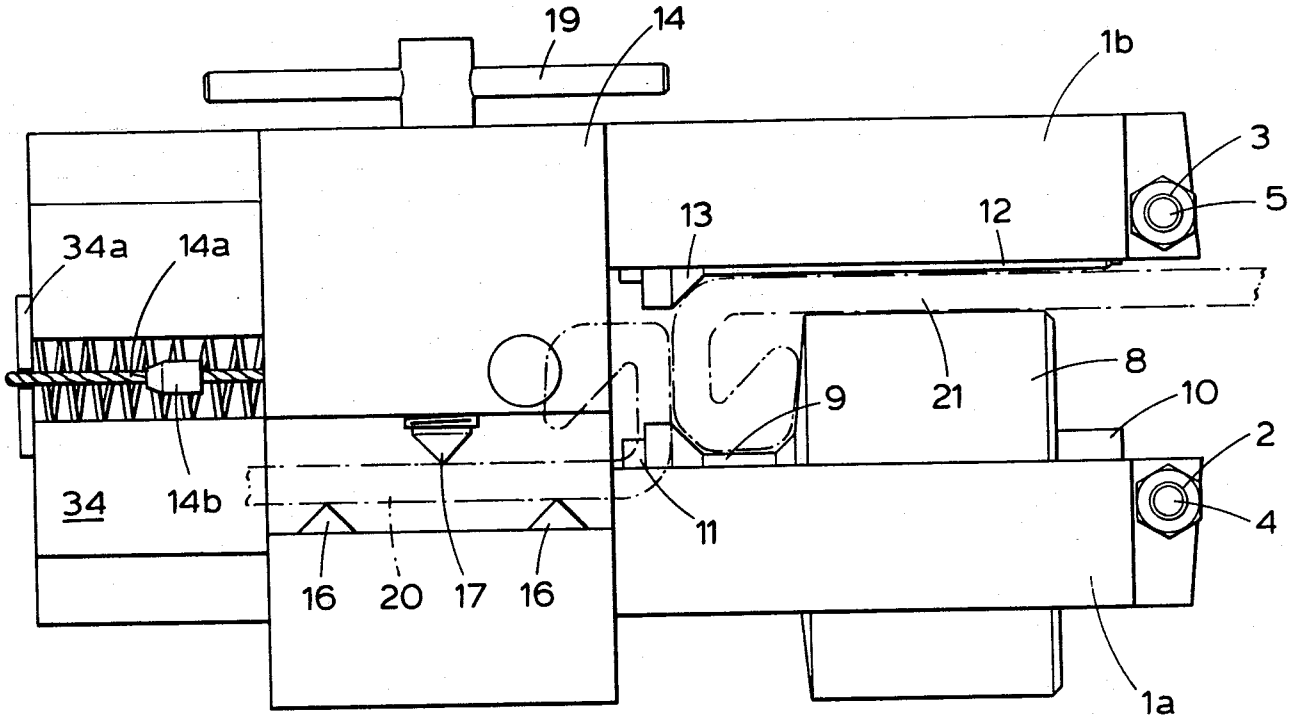
Figure 3:
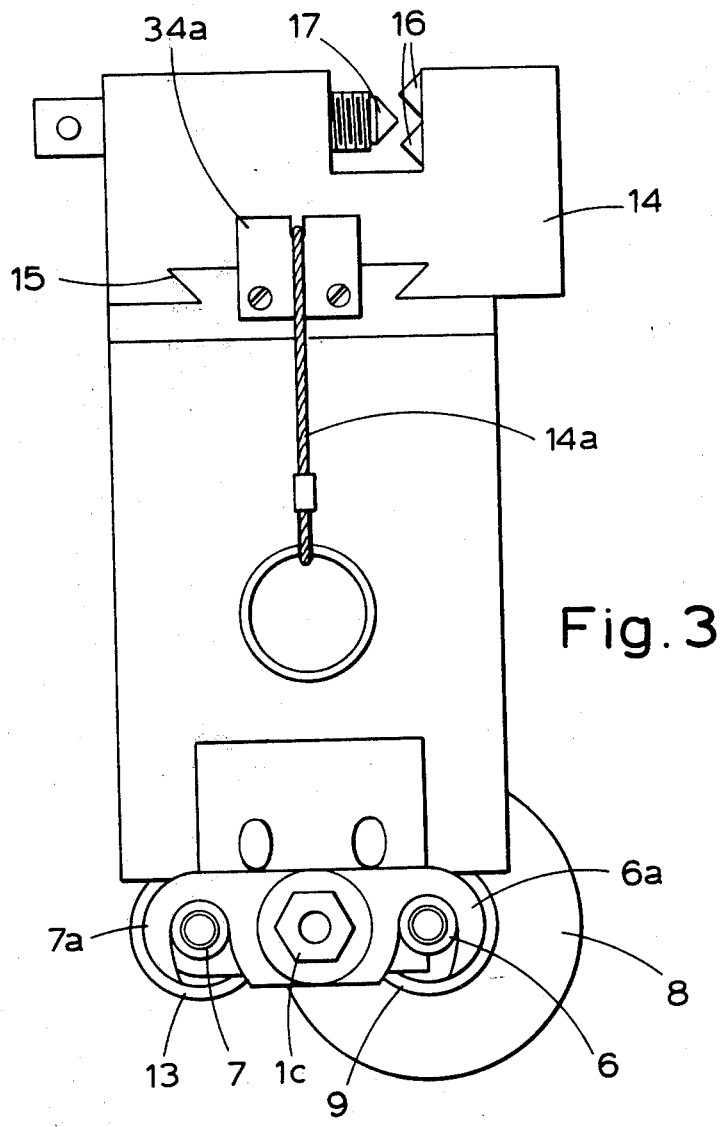

The guide shown in FIGS. 1 to 3 comprises a carrier 1, for example an aluminium casting, comprising a pair of vertical, horizontally spaced limbs 1*a*, 1*b* provided near their lower ends with a pair of horizontally spaced, vertically extending bores 2 and 3. Respective shafts 4 and 5 are rotatably mounted within the bores 2 and 3, and each of the shafts 4 and 5 carries a respective horizontally extending shaft 6 and 7. The shaft 6 carries a pair of rollers 8 and 9 removably mounted thereon end to end, the rollers being kept on the shaft 6 in the desired axial position by a pair of locking rings 10 and 11. The shaft 7 likewise carries a pair of rollers 12 and 13 removably positioned thereon. These rollers may conveniently be of a plastics material, though other materials are also suitable. The rotatable mounting of the shafts 4 and 5 enables them to be swung apart so as to open the gap between the rollers 8 and 9 and the rollers 12 and 13, for a purpose described below. To lock the shafts in their operative position in which they are substantially parallel, clips 6*a*, 7*a* are pivoted on the carrier by a bolt 1*c*.

Figure 6:
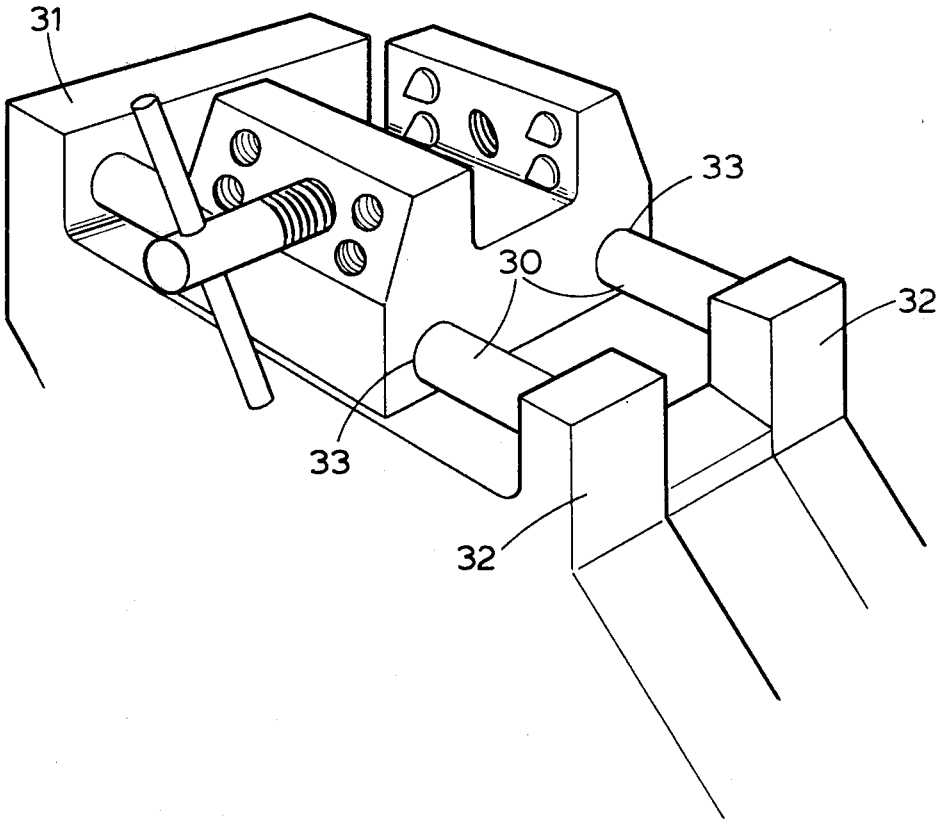
FIG. 6 is a perspective view of a modified form of connection of the clamping means of the guide in FIGS. 1 to 3, and FIGS. 7 and 8 show yet another embodiment of the invention in side elevation and end elevation respectively.

A clamp 14 for clamping the guide to a pile to be pitched is provided at the upper end of the carrier 1. The connection between the clamp 14 and the casting 1 may be in the form of a dovetail slide 15 which permits sliding movement between the clamp 14 and the carrier 1 in a direction to the left and to the right as seen in FIGS. 1 and 2, parallel to the shafts 6, 7. An alternative to the dovetail slide is shown in FIG. 6 which illustrates the use of tubular slide bars 30 mounted in upstanding portions 31 and 32 of the casting and received in bores 33 in the clamp which permit the clamp to slide on the bars. Means, for example a helical spring 34 between the clamp and fixed end plate 34*a* are provided for biasing the clamp 14 from its left-hand position (shown in dotted lines in FIG. 1) towards its right-hand position. The reason for this is explained below. It is convenient to provide a cocking device, comprising wire strap 14*a* fixed to the clamp 14 carrying a stop member 14*b* that can be held by end plate 34*a*, and by means of which the clamp 14 can be kept in its left-hand position against the force of the biassing means.

The clamp comprises fixed spaced jaws 14*a*, 14*b* from one of which project four pile engaging elements 16 and from the other of which projects a single movable pile engaging element 17 mounted on one end of a screw-threaded shaft 18. A handle 19 is secured to the other end of the shaft 18 to enable the element 17 to be screwed towards and away from the elements 16. The elements 16, 17 each have conical hardened-steel tips so that they are able to bite into the steel of a pile when the clamp is applied. Preferably all the elements are removable, e.g. by having screw-thread receiving bores and the receiving bores are duplicated in both jaws of the clamp, so that the fixed location provided by the elements 16 can be disposed on either side, as required.

The guide is shown in use with Larssen piles and is clamped on the bottom edge of one Larssen pile 20 which is to be pitched, by means of the clamp 14, the elements 16, 17 being forced into the surface of the pile so that it is positively gripped. The pile 20 with the guide thereon is then moved by a crane to a Larssen pile 21 already pitched, with the shafts 6, 7 swung open. The guide is located on the pile 21 by using the limbs 1*a*, 1*b* to position the guide so that the rollers are on opposite side of the pile 21 and then pivoting shaft to engage the rollers with the sides of the pile and locking them in position by means of the clips 6*a*, 7*a*. The cocking device is then released to allow the clamp 14 to be biassed towards its right-hand position by the biasing means. The pile 20 is lifted by the crane so that the guide is also lifted and in so doing the rollers 8, 9, 12 and 13 roll up the pitched pile 21. During this lifting the right-hand edge of the pile 20 is urged against the left-hand edge of the pile 21 by the biasing of the clamp 14, into sliding contact therewith. As will be observed the rollers are so shaped as to conform generally to the shape of the lateral edge portion of the pile which they engage, thereby ensuring the guide runs correctly up the pile 21 and with relatively little resistance.

Once the bottom edge of the pile 20 is at the top edge of the pile 21, the biassing on the clamp 14 causes the pile 20 to move in the direction of the arrow until in the correct position to interlock with the pile 21. The pile 20 is therefore now lowered. In this process the interlock portion of the pile 20 slides along the interlock portion of the pile 21 and the guide rolls down the pile 21. This continues until the pile 20 has been lowered to the desired extent. The guide is then removed from the piles 20 and 21 by turning the handle 19 and pivoting back the shafts 6, 7.

If now a further pile is to be pitched next to the pile 21, using the guide, the geometry of the Larssen pile dictates that the rollers on the shafts 6, and 7 must be removed and interchanged with one another before this next pitching operation. Alternatively two guides may be used in alteration, one being arranged for left hand operation and the other for right hand operation.

A feature of the guides shown is the relatively long lateral region of contact made possible by the arrangement of the profiled rollers. This helps to prevent rotation of the pile being pitched and enables the pile being pitched to be accurately located before being lowered.

Figure 4:
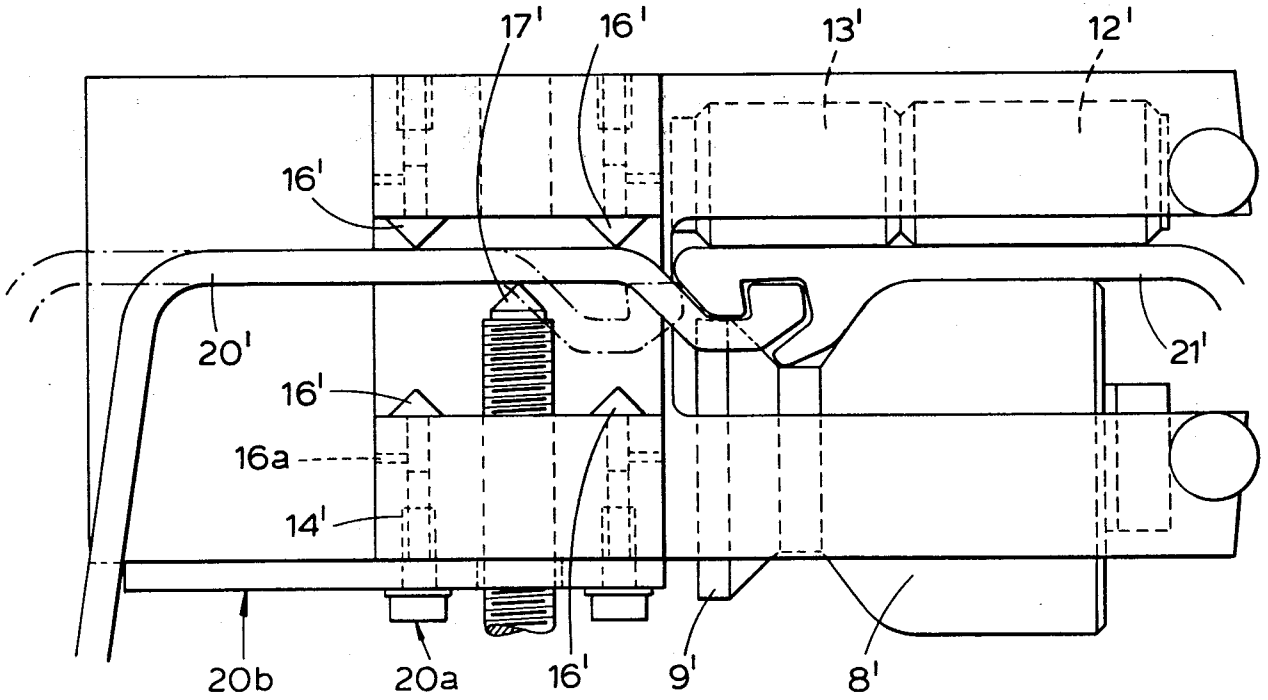
FIGS. 4 and 5 are plan views of guides, similar in many respects to the guide of FIGS. 1 to 3, but shown in use for pitching Z-section piles.
Figure 5:
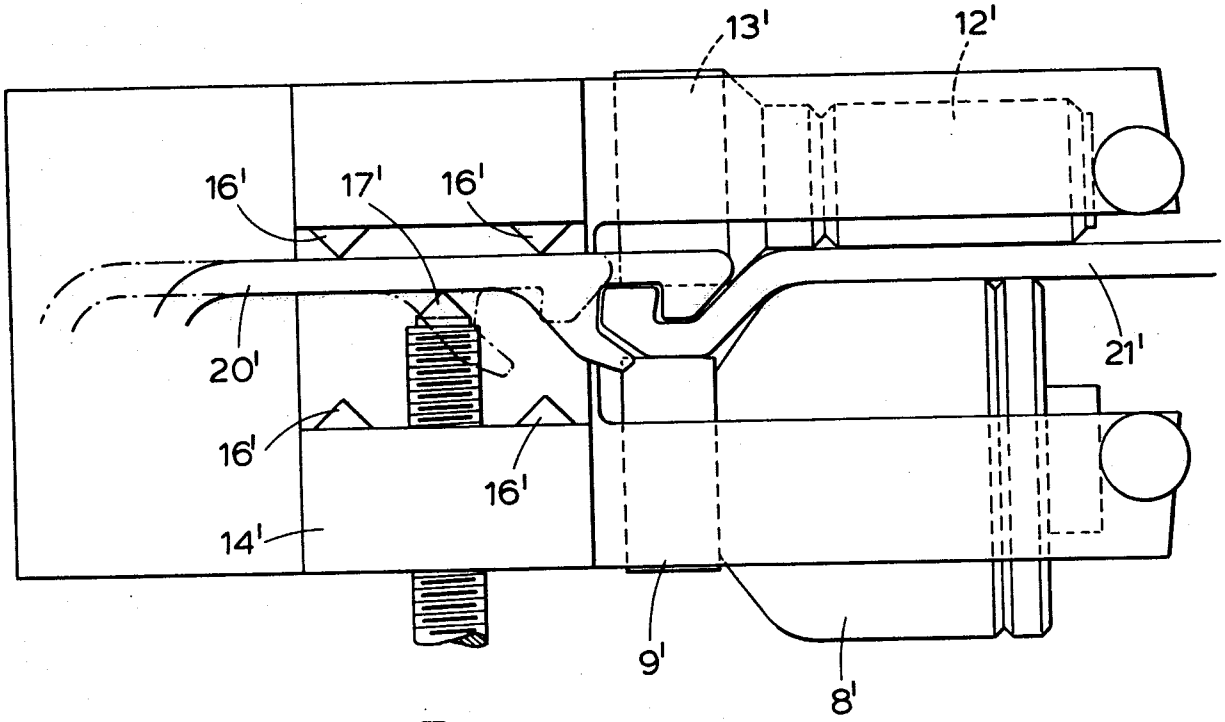

FIGS. 4 and 5 illustrate two forms of pile guide according to the invention adapted for pitching Z, U and flat or straight web type piles. They are both similar to the guide described with reference to FIGS. 1 to 3 and so will not be described in detail herein. The same or similar parts to those shown in FIGS. 1 to 3 are given the same reference numeral with the addition of a prime, but the arrangement of the clamp is slightly different and will be described below.

The Z section piles illustrated, unlike Larssen or U section piles, are not symmetrical, i.e. opposite lateral edges of each pile carry different forms of interlock and the guide rollers required depend on whether the first form of interlock is on the pile already pitched and the second form on the pile to be pitched or vice versa. It is possible either to use two different guides, or to have a single guide convertible from one configuration to the other. FIGS. 4 and 5 illustrate the latter possibility for the two different forms of interlock respectively.

Hard-point pile-engaging elements 16 are provided in both faces of the clamp 14 and the bolt carrying the movable pile-engaging element can be similarly duplicated or be removable and replaceable in either side of the clamp. The elements 16 are shown with plain cylindrical shanks, press fitted into their receiving bores in the clamp and locked in place by grub screws 16a seating in annular recesses in the shanks of the elements: they are not necessarily all of the same height. The bores are screw-threaded in their outer regions, however, to receive socket screws 20a for a distance plate 20b that locates the clamp relative to the pile section 20'. This plate 20b may also be duplicated at the other side of the clamp so that with each successive oppositely handed pile, to convert from one pitching operation to the other the bolt carrying the movable pile-engaging element 17' is removed and rethreaded from the opposite side of the clamp 14', and rollers 8', 9', 12' and 13' are removed from their shafts and relocated on the opposite shaft.

It should be noted, however, the Z-section piles are often supplied and pitched in pairs, and in that case a single guide can be used to pitch a continuous run of pairs of Z-section piles without these adjustments and without requiring a second distance plate.

Figure 7:
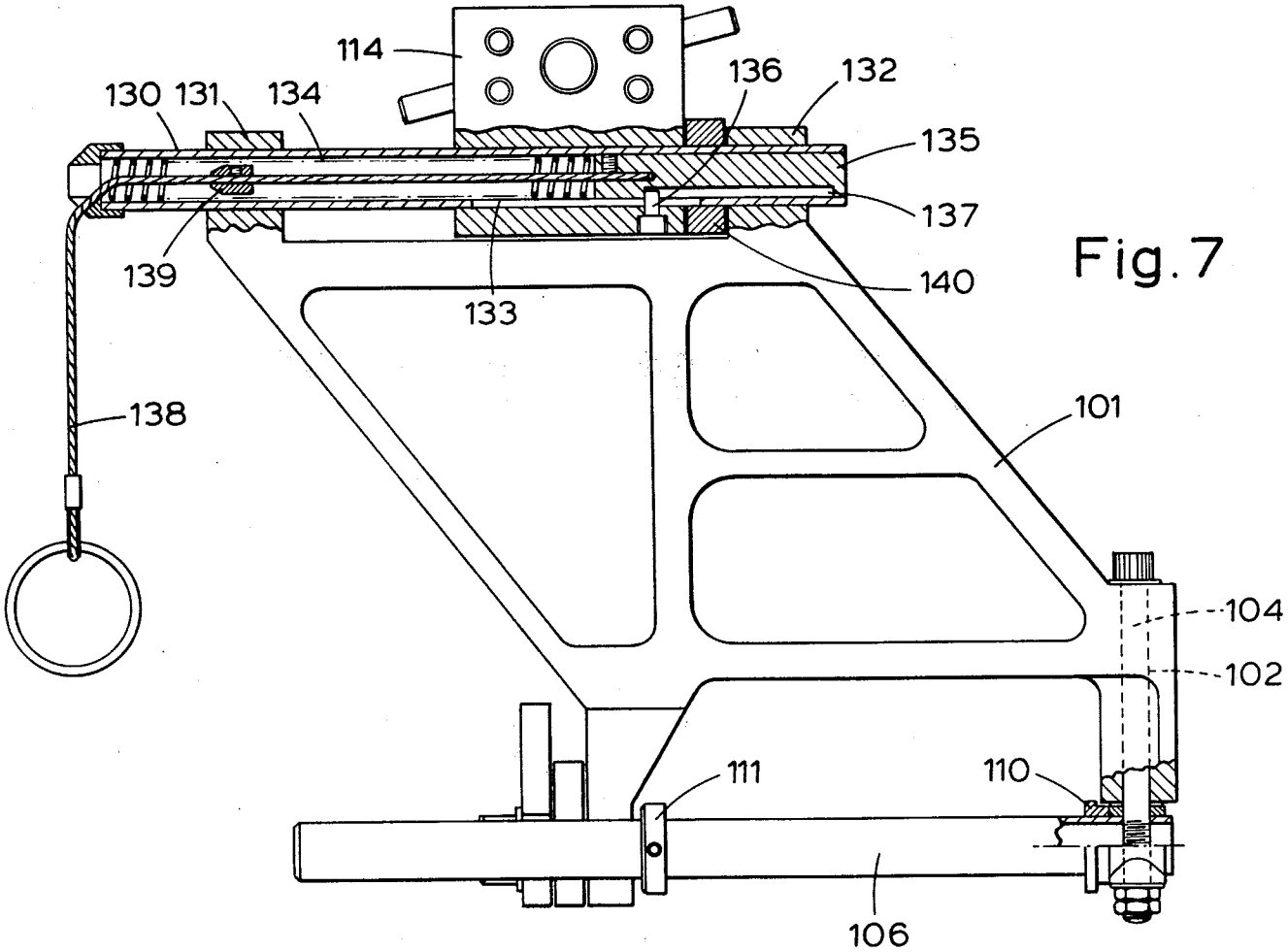
Figure 8:
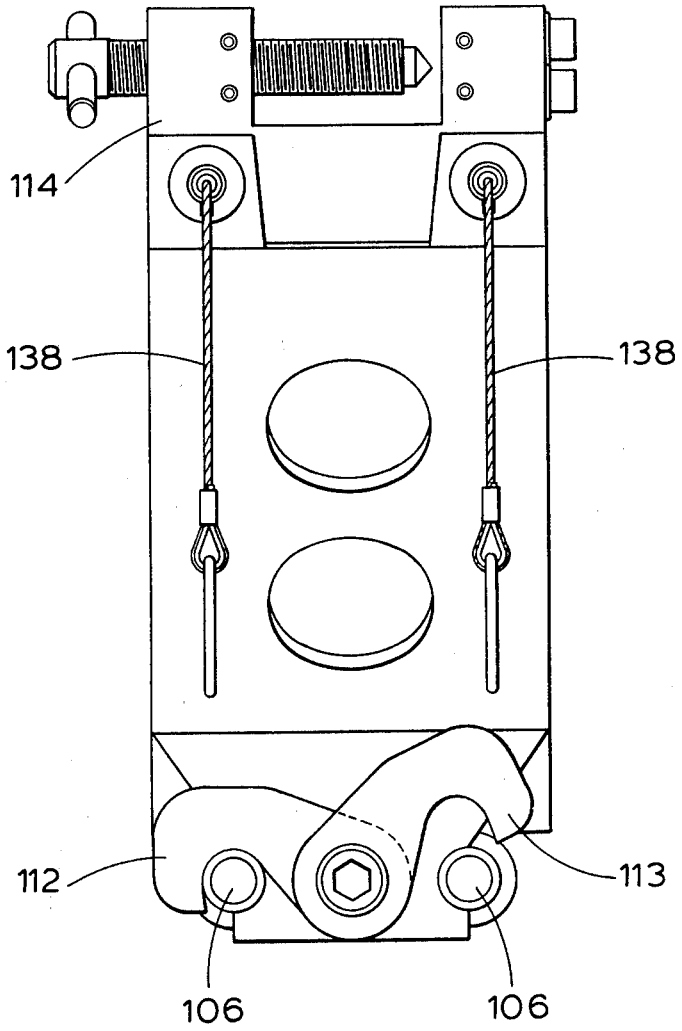

The guide shown in FIGS. 7 and 8 comprises a carrier 101, for example an aluminium casting, provided near its lower end with spaced limbs that have a pair of horizontally spaced vertically extending bores 102. Respective shafts 104 are pivotably mounted within the bores 102, and each of the shafts 104 carries a respective horizontally extending shaft 106. The shafts 106 each carry rollers (not shown) removably mounted thereon end to end, the rollers being kept on each shaft 106 in the desired position by a pair of locking rings 110 and 111. The pivotable mounting of the shafts 104 enables the rollers of one shaft 106 to be swung away from the rollers of the other shaft 106. To lock the rollers in their operative position in which they are not swung apart, suitable clips 112 and 113 are provided, clip 112 being illustrated in its closed position, and clip 113 in its open position. It will be understood that in these respects the arrangement is generally the same as that in the first-described embodiment.

A clamp 114 for clamping the guide to a pile to be pitched is provided at the upper end of the carrier 101, and has the gripping elements that have already been described. The connection between the clamp 114 and the carrier 101 is provided by tubular slide bars 130 mounted in upstanding portions 131 and 132 of the carrier and received in bores 133 in the clamp which permit the clamp to slide on the bars. Helical springs 134 are provided for biassing the clamp 114 towards its right-hand position as seen in FIG. 7. They act through a plunger 135 slidably received in each bar 130 and secured to the clamp 114 by grub screws 136 received in a respective slot 137 in each plunger 135.

A cocking device is provided by means of which the clamp 114 can be kept in its left-hand position against the force of the biassing means. The cocking device comprises a pair of wire straps 138 each secured to a respective plunger 135 and carrying a stop member 139. Cocking is effected by pulling each wire strap in turn leftwardly to bring its stop member out of the bore 133 and then downwardly to cause the stop member to be caught at the chamfer on the left-hand end of its bar 130. Cocking is released by pulling both straps upwardly to free the stop members from the end of the bars so that the springs 134 are free to expand.

Adjustment of the stroke of the clamp on the bars 130 can be made by replacing spacer washer 140 with one of a different thickness. This adjustment can also be provided in the construction shown in FIG. 6 and it will be understood without further illustration that an analogous arrangement can be provided in the guide of FIGS. 1 to 3.

What is claimed is:

1. A guide for guiding a pile during pitching said pile with a portion of a lateral edge region of the pile in engagement with a portion of a lateral edge region of an already-pitched pile, the guide comprising a carrier, clamping means at an upper region of the carrier for securing the guide to the bottom of the pile being pitched at said lateral edge region thereof, engagement means at a lower region of the carrier for engaging the guide with said lateral edge region of the previously pitched pile, said engagement means comprising a pair of shafts side-by-side, a pivotable connection between at least one of said shafts and the carrier for displacement of said shaft away from the other shaft, means for locking said at least one shaft against pivotal movement on said connection to hold the two shafts substantially parallel, at least one roller on each said shaft, said rollers engaging opposite side faces of said lateral edge region of the already-pitched pile, the rollers having profiles conforming generally to the profiles of the faces of the pile lateral edge region that they engage, and biassing means on said carrier for causing relative displacement between said clamping means and said engagement means whereby, when the pile being pitched is above the level of the already-pitched pile with the rollers engaging the already-pitched pile, the biassing means urge the pile being pitched into the correct lateral position for engagement of said lateral edge portions of the two piles.

2. A guide according to claim 1 wherein said clamping means for the pile being pitched comprises a series of gripping elements having small-area gripping portions for deformation of portions of the pile contacted whereby to positively lock the clamping means to the pile.

3. A guide according to claim 2 wherein said clamping means comprise opposed jaws, a plurality of said gripping elements mounted on one of the jaws to project towards the other jaw, a clamping member on the other jaw, a further gripping element on said clamping member projecting towards said one jaw, said clamping member being adjustable in its jaw to apply the clamping pressure to the pile being pitched with said plurality of elements on one face of the pile and said further gripping element on the opposite face of the pile.

4. A guide according to claim 3 wherein the opposed jaws each have engagement means for removably receiving said plurality of gripping elements and said clamping member, whereby said gripping elements and clamping member may be selectively received in either jaw of said clamping means.

5. A guide according to claim 1 wherein slide means are provided on said upper region of the carrier and mount the clamping means displaceably parallel to said shafts, and said biassing means urge the clamping means to one end position on said slide means.

6. A guide according to claim 5 wherein cocking means are provided for holding said clamping means in an opposite end position to said one end position, against the force of the biassing means.

7. A guide according to claim 1 comprising means for adjusting the extent of the relative displacement between said clamping means and said engagement means.

8. A guide according to claim 1 wherein the carrier comprises a pair of spaced limbs to which the respective shafts of said pair of shafts are attached, the spacing between said limbs being similar to the spacing between the shafts for permitting entry between said limbs of the lateral edge region of the already-pitched pile before said region is engaged by the shaft rollers.

9. A guide according to claim 1 wherein the rollers are removably mounted on the shafts.

10. A guide according to claim 9 wherein means are provided for adjustably locating the rollers axially of the shaft.

11. A guide for guiding a pile during pitching said pile with a portion of a lateral edge region of the pile in engagement with a portion of a lateral edge region of an already-pitched pile, the guide comprising a carrier, slide means at an upper region of said carrier, a clamping device mounted on said slide means to be displaceable laterally of the carrier, biassing means on the carrier for urging said clamping device to an end position on said slide means, adjustable gripping elements on said clamping means for releasably securing the guide to the bottom of the pile being pitched at said lateral edge region thereof, a pair of pivot members dependent from a lower region of the carrier defining downwardly extending pivot axes, engagement means for the already-pitched pile comprising a pair of substantially horizontal shaft members each mounted at one end on one of said pivot members to be pivotable towards and away from each other, means on said carrier for engaging said shafts in the region of their ends remote from the pivot members to lock the shafts side-by-side and substantially parallel to said slide means, a plurality of rollers removably mounted on the shaft members, said rollers engaging opposite side faces of said lateral edge region of the already-pitched pile and having profiles conforming generally to the profiles of the faces of the lateral edge region that they engage, whereby the guide can be first secured to the bottom of the pile to be pitched and be positioned against the already-pitched pile with the shaft members of the engagement means spread apart, said shaft members being pivoted to said substantially parallel positions and locked in place to simultaneously align with and grip said edge region of the already pitched pile, and the biasing means act when the pile being pitched is raised above the level of the already-pitched pile to urge the pile being pitched into the correct lateral position for engagement of said lateral edge portions of the pile.

* * * * *